US007757724B2

(12) United States Patent
Li et al.

(10) Patent No.: US 7,757,724 B2
(45) Date of Patent: Jul. 20, 2010

(54) MEDICATION DISPENSING DEVICE

(75) Inventors: Ming-Hsin Li, Taoyuan (TW); Wuu-Jyh Lin, Taoyuan (TW); Cheng-Hung Chien, Taoyuan (TW); Jun-Chieh Tsai, Taoyuan (TW); Wun-Shen Lan, Taoyuan (TW)

(73) Assignee: Institute of Nuclear Energy Research, Jiaan Village, Longtan, Taoyuan (TW)

( * ) Notice: Subject to any disclaimer, the term of this patent is extended or adjusted under 35 U.S.C. 154(b) by 991 days.

(21) Appl. No.: 11/458,692

(22) Filed: Jul. 20, 2006

(65) Prior Publication Data

US 2008/0097370 A1 Apr. 24, 2008

(51) Int. Cl.
*B65B 31/04* (2006.01)

(52) U.S. Cl. ..... 141/59; 141/286; 141/329; 600/577; 604/406; 604/411

(58) Field of Classification Search ..... 141/7, 141/85, 285, 286, 300, 329, 59; 600/577; 604/406, 411
See application file for complete search history.

(56) References Cited

U.S. PATENT DOCUMENTS 3,063,451 A * 11/1962 Kowalk ..... 600/576
4,058,121 A * 11/1977 Choksi et al. ..... 604/411
4,276,170 A * 6/1981 Vaillancourt ..... 210/436
4,801,047 A 1/1989 Klatte
5,047,147 A * 9/1991 Chevallet et al. ..... 210/101
5,300,042 A 4/1994 Kossoff
7,032,631 B2 * 4/2006 Py ..... 141/82

* cited by examiner

*Primary Examiner*—Gregory L Huson
*Assistant Examiner*—Jason K Niesz

(57) ABSTRACT

An improved medication dispensing device includes an apyrexia receptacle, a transport pipeline, a perfusion device, a filter, and a dispensing needle, which operates in an environment in compliance with Class 100 laminar air ventilation. The perfusion device erected at the middle of the transport pipeline which has two ends linking to the apyrexia receptacle and the filter, respectively. In operation, the perfusion device pumps the prepared medication solution from the apyrexia receptacle to get through the filter to remove particles and bacterium, and a thin tubular dispensing needle which punctures the rubber plug of an aseptic bottle. An axial groove rendered in middle section of the dispensing needle forms a pressurized seal part with the rubber plug resiliently wrapped around at the middle of the dispensing needle to discharge redundant air pressure accumulating in the aseptic bottle while keeps outside air from entering.

5 Claims, 3 Drawing Sheets

MEDICATION DISPENSING DEVICE

BACKGROUND OF INVENTION

1. Field of the Invention

The present invention relates to an improved medication dispensing device, and particularly to a fill dispensing needle structure that can automatically discharge air pressure in the medication bottle to avoid the medication within from outside pollution.

2. Description of Related Art

A conventional medication dispensing device is shown in FIG. 1, it uses a pumping device to transfer the prepared medication solution stored in the apyrexia receptacle by a transport pipeline through a filter to filter out particles and bacteria. The medication solution is syringed into an aseptic bottle by a dispensing needle which punctures the rubber plug to produce injection medication in a bottle, and there is an aeration needle penetrating the rubber plug for pressure release to avoid pressure accumulated in the aseptic bottle during medication dispensing process. The other way to produce injection medication is to syringe the medication solution directly into a vacant glass bottle, seal the bottle, and followed by high pressure disinfection. However, the connecting structure using aeration needle and an aseptic bottle (or the vacant glass bottle) may cause medication solution to be infected during dispensing process if the operation could not be controlled effectively.

To overcome the shortcomings, the present invention tends to provide an improved medication dispensing device to mitigate and obviate the aforementioned problems.

SUMMARY OF THE INVENTION

The primary objective of the present invention is to provide an improved medication dispensing device.

In order to achieve the object set forth, An improved medication dispensing device includes an apyrexia receptacle, a transport pipeline, a pumping device, a filter, and a dispensing needle, which operates in the environment in compliance with Class 100 laminar air ventilation. The pumping device erected at the middle of the transport pipeline which has two ends link to the apyrexia receptacle and the filter, respectively. In operation, the pumping device pumps the prepared medication solution from the apyrexia receptacle to get through the filter to remove particles and bacterium, and a thin tubular dispensing needle which punctures the rubber plug of an aseptic bottle. An axial groove rendered in the middle section of the dispensing needle forms a loose seal part tab with the rubber plug resiliently wrapped around at the middle of the dispensing needle to discharge redundant air pressure accumulating in the aseptic bottle while keeps outside air from entering.

The other object of the present invention is to reduce the severe environmental equipment request and product cost appropriately by blocking the medication bottle from pollution.

DETAILED DESCRIPTION OF THE PREFERRED EMBODIMENT

The detailed structure and applied theorem, function, effect can be comprehensible with reference to the following drawings.

Figure 1:
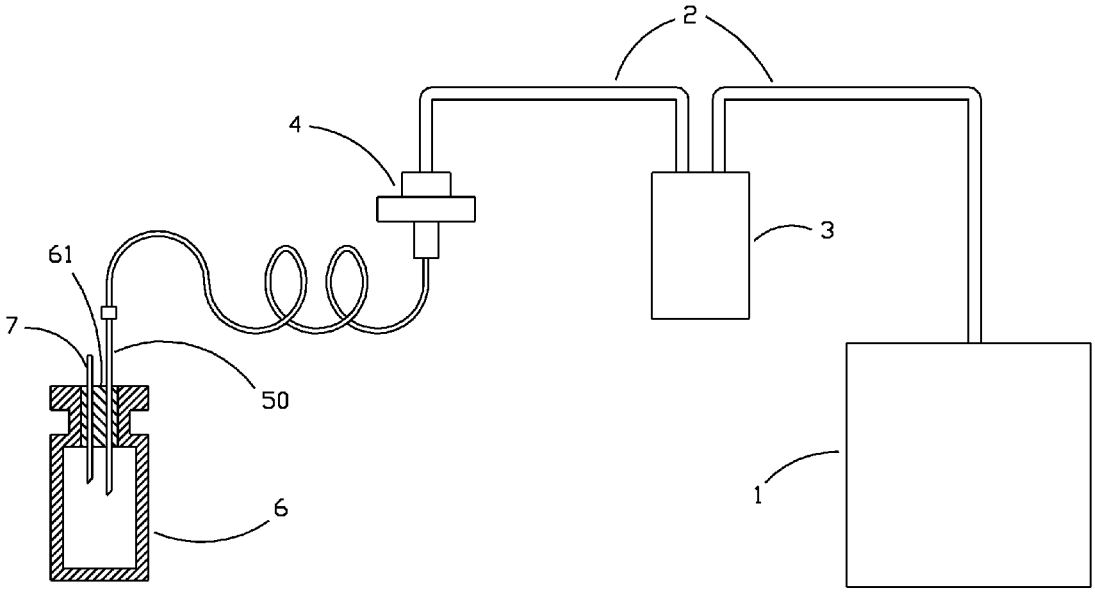
FIG. 1 indicates a conventional medication dispensing device.

FIG. 1 illustrates a conventional medication dispensing device with shortcomings as known as fore mentioned.

Figure 2:
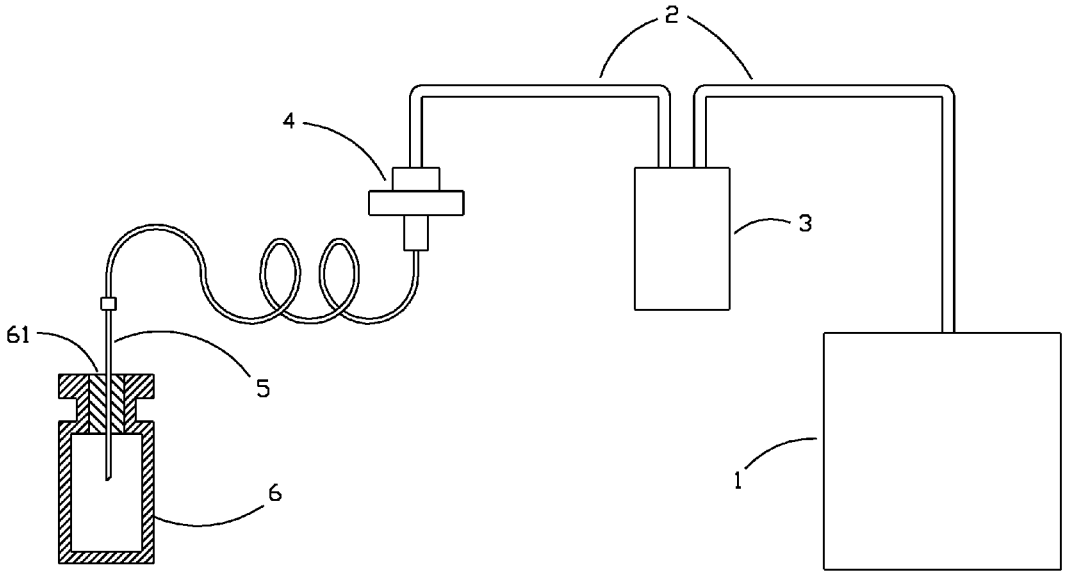
FIG. 2 illustrates an improved medication dispensing device in accordance with the present invention.
Figure 3:
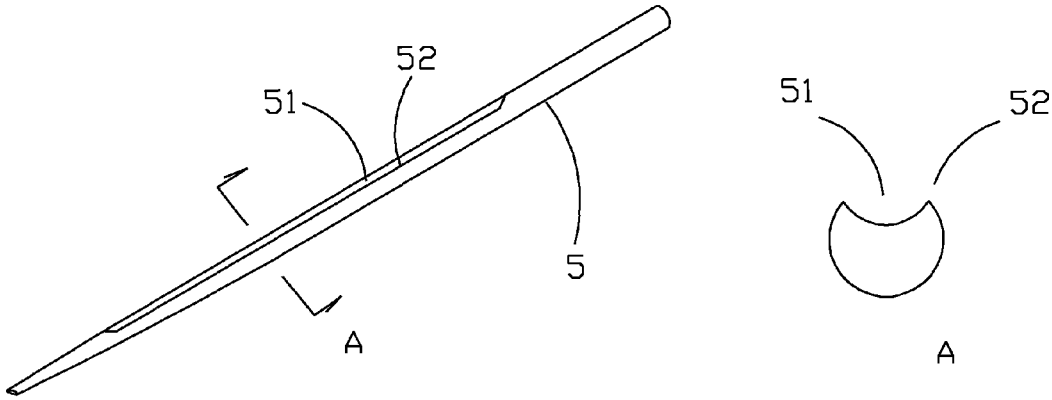
FIG. 3 illustrates a dispensing needle in accordance with the present invention.
Figure 4:
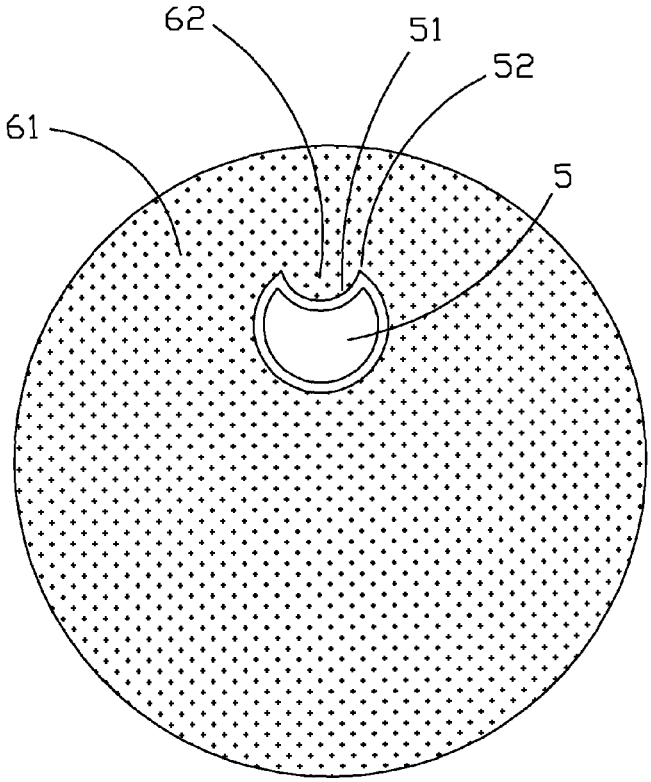
FIG. 4 is a cross-section view of a dispensing needle in accordance with the present invention.

With reference to FIG. 2 and in comparison with FIGS. 3 and 4, the whole structure of the present invention relates to a medication dispensing device which operates in an environment in compliance with Class 100 laminar air ventilation comprising an apyrexia receptacle 1, a transport pipeline 2, a pumping device 3, a filter 4, and a dispensing needle 5, wherein the apyrexia receptacle 1 is connected to the pumping device 3 with the transport pipeline 2, and the other end of the pumping device 3 is connected to the filter 4, and the filter 4 is connected to the dispensing needle 5 puncturing the rubber plug 61 into the aseptic bottle.

The fore mentioned dispensing needle 5 is designed in a thin tubular shape with an axial groove 51 having tapered and U-shaped cross section structure with sharpen edges 52 rendered at outer portion of the middle section of the dispensing needle 5, which can be wrapped around tightly by the rubber plug 61 forming a pressurization effect, and the rubber plug 61 will form a loose seal part tab 62 at the groove 51 portion while puncturing into the aseptic bottle 6. The medication solution will be pumped by the pumping device 3, passed through the filter 4 to filter out particles and bacterium, and then led into the aseptic bottle 6 through the dispensing needle 5. After the pressure being gradually accumulated in the aseptic bottle 6, it will push the loose seal part tab 62 to become deformed in eversion, discharge redundant air, and release pressure to reach a pressure balance. Therefore, the aseptic bottle 6 is ensured free from pollution for this one-way buildup pressure release while the process of medication dispensing being accomplished smoothly.

It could be known through above that the improved medication dispensing device of the present invention provides an effect of discharging redundant air pressure in the aseptic bottle automatically to avoid pollution from outside.

Although the present invention has been described with reference to a preferred embodiment thereof, it is apparent to those skilled in the art that there are a variety of modifications and changes that may be made without departing from the scope of the present invention which is intended to be defined by the appended claims.

The invention claimed is:

1. An improved medication dispensing device comprising:

a apyrexia receptacle provided to save prepared medication solution;

a transport pipeline connecting a apyrexia receptacle and a filter to filtrate the medication solution;

a pumping device erected at the middle section of the transport pipeline to pump the medication solution from the apyrexia receptacle to pass through the filter; wherein:

a dispensing needle with a thin tubular shape having an axial groove rendered at outer portion of the middle section of the dispensing needle, which can be wrapped around tightly by the rubber plug forming a pressurization effect, the axial groove being of a shape such that the rubber plug will form a loose seal part at the groove portion while the dispensing needle puncturing into the aseptic bottle.

2. An improved medication dispensing device as claimed in claim 1, wherein the apyrexia receptacle, transport pipeline, pumping device, filter, and the dispensing needle are erected in compliance with Class 100 laminar air ventilation environment.

3. An improved medication dispensing device as claimed in claim 1, wherein the filter is provided with a 0.22 μm film to filter out particles and bacteria.

4. An improved medication dispensing device as claimed in claim 1, wherein the pipeline is made of material proof of acid and alkali.

5. An improved medication dispensing device as claimed in claim 2, wherein the pipeline is made of material proof of acid and alkali.

* * * * *